US005360315A

United States Patent [19]

Kurkowski et al.

[11] Patent Number: 5,360,315

[45] Date of Patent: Nov. 1, 1994

[54] PRINTED WORK STATION FOR PRINTING PRESS

[75] Inventors: Ronald J. Kurkowski, Appleton; Mark S. Mielke, Neenah, both of Wis.

[73] Assignee: Outlooks Graphics Corp., Neenah, Wis.

[21] Appl. No.: 941

[22] Filed: Jan. 5, 1993

[51] Int. Cl.[5] ..... B65H 31/32; B65G 57/03

[52] U.S. Cl. ..... 414/790.8; 414/793.8; 414/789.9

[58] Field of Search ..... 414/789.9, 790.8, 793.8

[56] References Cited

U.S. PATENT DOCUMENTS

| | | | |
|---|---|---|---|
| 3,148,780 | 9/1964 | Lindemann | 414/790.8 |
| 4,222,697 | 9/1980 | Vits | 414/790.8 |
| 4,541,763 | 9/1985 | Chandhoke et al. | 414/790.8 |
| 4,799,847 | 1/1989 | Bodewein | 414/790.8 |
| 4,949,953 | 8/1990 | Claassen et al. | 414/790.8 |
| 5,090,681 | 2/1992 | Henn et al. | 414/790.8 |
| 5,145,159 | 9/1992 | Vits | 414/790.8 |

FOREIGN PATENT DOCUMENTS 3136950 10/1982 Germany ..... 414/790.8

OTHER PUBLICATIONS

Heidelberg pallet fork in storage position.
Heidelberg pallet fork in an employed position.

*Primary Examiner*—Michael S. Huppert
*Assistant Examiner*—Gregory A. Morse
*Attorney, Agent, or Firm*—Quarles & Brady

[57] ABSTRACT

A false pallet top hingedly connected to a printed work receiving station for a printing press is disclosed, the printing press having a printed works outlet, the station including an apparatus for raising an empty pallet to receive printed work from the outlet and for lowering the pallet as it becomes loaded with printed work. The false pallet top, comprising a single substantially rectangular sheet of rigid material covered with a low friction coating, can easily be moved from a stored vertical position into a horizontal position and slid between printed works within the receiving station allowing a full pallet to be removed and replaced with an empty pallet without stopping the printing press. After an empty pallet is properly positioned, the false pallet can be easily pulled out and placed in the stored position.

7 Claims, 3 Drawing Sheets

FIG.5
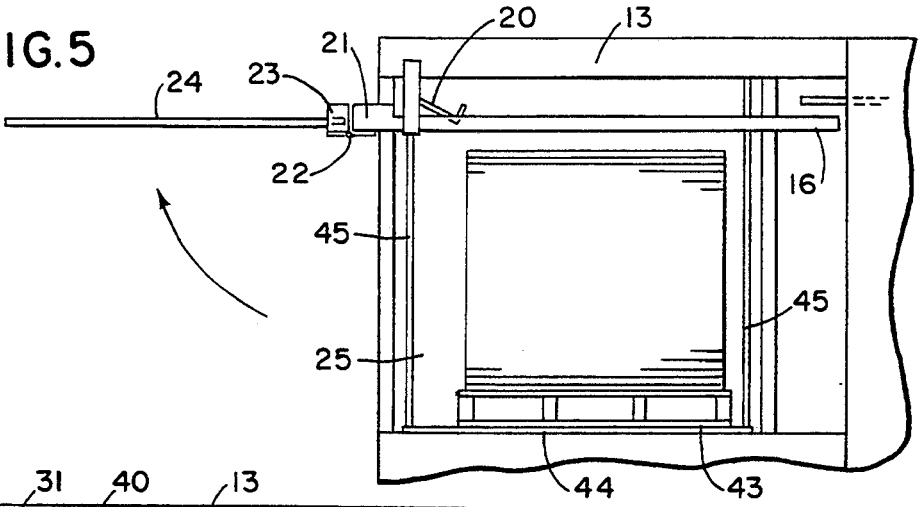
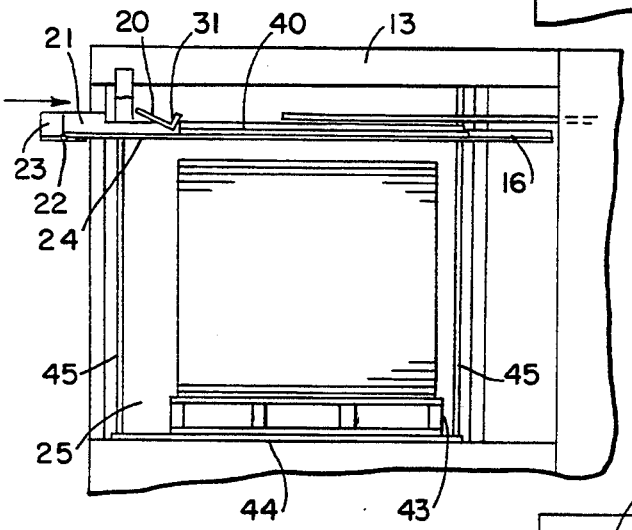
FIG. 6
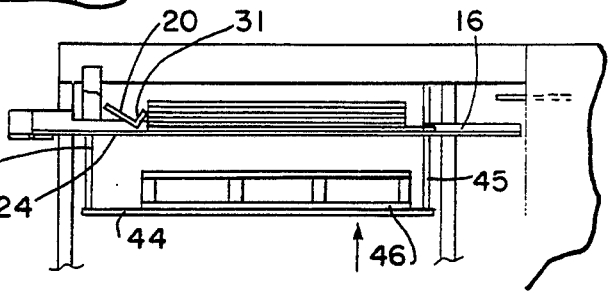
FIG. 7
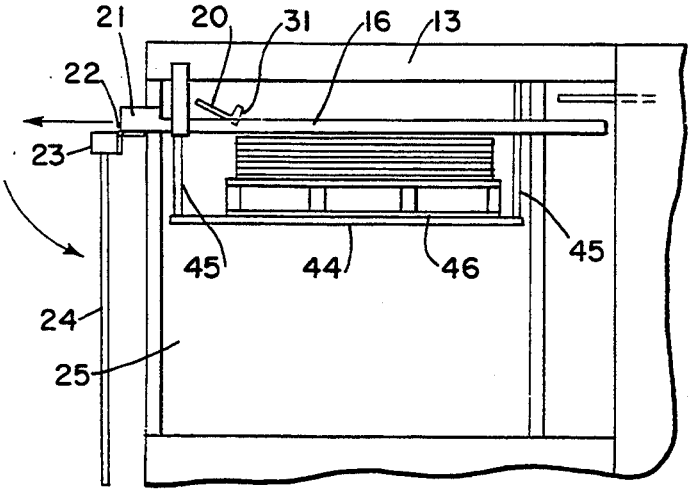
FIG. 8

PRINTED WORK STATION FOR PRINTING PRESS

FIELD OF THE INVENTION

The present invention relates generally to the printing industry. More particularly, it relates to a printed work receiving station for use with a printing press.

BACKGROUND OF THE INVENTION

It is most economical to operate high speed presses continuously because downtime not only increases labor and other operating costs but it also can increase the chances of producing unusable printed material. While press manufacturers have eliminated one possible source of downtime by providing means for insuring a continuous supply of paper to be printed, downtime can still result because of the need to stop the press to remove accumulated printed work.

One approach to handling the output of printed work from a press is to provide a printed work receiving station at the outlet of the press which includes motorized means for both raising an empty pallet to the outlet of the press to receive printed work and lowering a fully loaded pallet for removal. This approach has many advantages and it works well for smaller runs. However on long runs, it is still necessary that the press be shut down when a pallet becomes fully loaded so that it can be replaced with an empty pallet.

An apparatus which enables long printing runs without shutting down the printing press includes a thin piece of plywood that is received between two horizontal support tracks, the tracks being pivotally positioned at the outlet of the printing press above and parallel to the top of a loaded pallet. Once a pallet is fully loaded, without turning off the printing press, the sheet of plywood is inserted between the two support tracks in a horizontal printed work receiving position permitting printed work to be collected on the sheet of plywood. After insertion of the plywood sheet the loaded pallet is lowered and replaced with an empty pallet. The empty pallet then can be raised up into a receiving position for the printed work directly under the plywood sheet. The support tracks are pivotally moved out of the their supporting position along the edges of the plywood sheet allowing the plywood sheet and the collected printed work thereon to fall onto the empty pallet. New printed work exiting from the outlet of the press then accumulates on the new pallet.

Although an apparatus of the above kind enables long printing runs without the need to turn off the press, the large quantities of plywood necessary for long runs can be very expensive. Each time a plywood sheet is inserted into the receiving area, because of the friction between the plywood and the accumulated printed work thereon, the plywood must remain underneath the printed work and cannot be easily removed until the printed work is taken off the sheet. In many instances, printed work will remain on a loaded pallet for days and even weeks at a time, thus rendering the plywood sheet between the printed work and the pallet unusable for a second pallet exchange.

Long printing runs that do not use plywood have been accomplished by employing a large metallic multi-pronged fork like apparatus (fork) that is inserted above a loaded pallet in place of the plywood. Utilizing this apparatus, after a full pallet is replaced with an empty pallet, and the empty pallet is raised up below the fork, the fork is removed from under the printed work collected thereon to permit that printed work and additional printed work exiting the press outlet to collect upon the top of the previously empty pallet. The fork, instead of being supported by support tracks that outwardly pivot, is supported on its peripheral edges by linear bearings that are supposed to allow the fork to be inserted and removed easily. Using a multi-pronged fork instead of a full plywood sheet, the actual surface area of the temporary printed work collector that frictionally contacts the printed works is minimized and therefore, removal of the collector, without the printed work following, is facilitated.

One problem with the fork apparatus is that many printed works may exit the printing press with a certain degree of curl or bow in them. When the fork like apparatus is inserted, printed work having curl or bow many times may come off the press under some of the fork prongs and on top of others, in effect woven between the prongs of the fork. When a printed work is woven under even a single fork prong, the friction between the prong and the printed work increases substantially. Upon removal of the fork, interwoven printed works follow the apparatus out of, or partially out of, the printed work receiving station and many times are destroyed or rendered unusable.

Another problem with the fork apparatus is that the linear bearings that support the apparatus quickly wear out. Worn linear bearings either have to be replaced or the fork operator must struggle to insert and remove the fork apparatus.

It would be advantageous to have an improved durable work receiving station that would permit a full pallet to be replaced by an empty pallet without shutting down the press and without destroying any of the printed works.

BRIEF SUMMARY OF THE INVENTION

It is a primary object of the present invention to disclose an improved printed work receiving station for a printing press that permits a full pallet of printed work to be replaced with an empty pallet without shutting down the printing press and without damaging any of the printed works.

The improved printed work receiving station of the present invention, which includes means for raising an empty pallet to a receiving position adjacent the outlet of a printing press and for lowering a loaded pallet, also includes a novel false pallet top and means for supporting the false pallet top that completely covers the top of a loaded pallet in a horizontal position above and parallel to the top of a loaded pallet. The printed work which exits from the outlet of the printing press when the false pallet top is in the horizontal position collects upon the false pallet top and permits the loaded pallet to be lowered and replaced with an empty pallet. The empty pallet then can be raised up into a receiving position for the printed work and the false pallet top easily withdrawn to permit the printed work that was on the false pallet top to rest upon the top of the empty pallet and to permit new printed work exiting from the outlet of the press to accumulate thereon.

In its simplest embodiment, the false pallet top is a flat imperforated aluminum plate having both a lubricating plastic covering such as PTFE, sold under the trademark TEFLON, covering and a tapered leading edge which facilitate inserting the pallet between adjacent pieces of printed work near the output of a printing press. The lubricating plastic covering also acts to reduce friction between the raise pallet top and the accumulated printed works so that the false pallet top (unlike a high friction plywood sheet) can easily be removed from within the printed work receiving area without the printed works following. The false pallet top has a hand hole for ease of handling. The plate also can be perforated, if desired.

Because the false pallet top of the present invention completely covers the entire planar space between the support tracks, no printed works can become interwoven between parts of the false pallet top. Therefore, upon removal of the false pallet top, no printed works are rendered unusable In the preferred printed work station of the present invention the means for supporting the false pallet top is a pair of spaced-apart horizontal tracks for supporting the false pallet top in a horizontal printed work receiving position adjacent the press outlet. The present invention also includes at least one printed work retaining member which keeps the printed work from following the false pallet top when it is being withdrawn from the horizontal position and moved into a vertical storage position.

In the preferred embodiment, the false pallet top also includes a hinged member which removably engages the plate as it is withdrawn from the horizontal printed work receiving position and permits it to be stored in a vertical position.

It is another object of the present invention to disclose a temporary work collector that is durable and easy to insert and remove. The false pallet top may be fitted with nylon runners on its peripheral edges that actually contact the support tracks. Nylon runners are very resilient and hence will only minimally wear during use. Nylon runners also have a small coefficient of friction with the support tracks which they contact making insertion and removal of the false pallet top easy.

In operation, when a pallet is fully loaded, without turning off the press, an operator temporarily inserts a false pallet top into a horizontal printed work-receiving position parallel to and above the top of a loaded pallet adjacent to the outlet of a printing press and permits printed work to collect on the false pallet top, the operator then lowers the loaded pallet from under the false pallet top, replaces the loaded pallet with an empty pallet which is raised into a printed work receiving position. Then the operator removes the false pallet top from under the printed work collected thereon and permits that printed work and additional printed work exiting the press outlet to collect upon the top of the previously empty pallet.

The foregoing and other objects and advantages of the present invention will appear from the following description. In the description, reference is made to the accompanying drawings which form a part hereof and in which there is shown byway of illustration a preferred embodiments of the invention. Such embodiment does not necessarily represent the full scope of the invention, however, and reference must be made therefore to the claims herein for interpreting the scope of the invention.

DESCRIPTION OF THE DRAWINGS

In the drawings:

FIGS. 5 through 8 are simplified views of the printed work-receiving station of FIG. 1 illustrating the method of the present invention.

DESCRIPTION OF THE PREFERRED EMBODIMENT

Figure 1:
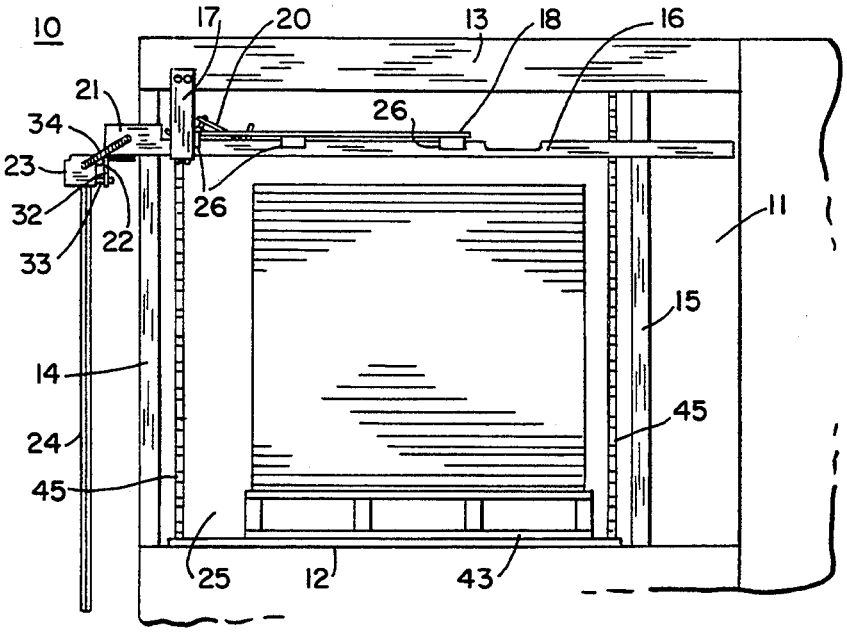
FIG. 1 is a side elevation view showing a printed work-receiving station with the false pallet top of the present invention in a vertical stored position.

FIG. 1 shows the invention embodied as a printed work receiving station 10 positioned adjacent the outlet of a printing press (not shown).

As seen in FIG. 1, the station 10 includes a frame, generally referred to as 11, having a base 12, a horizontal top 13, a vertical pallet end wall 14 and a vertical press end wall 15. The station 10 also includes a pair of parallel support tracks 16 suspended below the top 13 by two elbow brackets 17. A cover strip 18 is attached directly above each of the two tracks 16 and extends partially along the length of each track 16. A cross bar 19 is securely fastened between the two cover strips 18 adjacent the elbow brackets 17 and serves as a mounting base for a pair of printed work retaining members 20. Each track 16 also has a track extension 21 that extends through an opening in the pallet end wall 14. Two hinges 22 are securely fastened between the bottom of the track extensions 21 and two pivot stops 23. A false pallet top 24 is mounted between the pivot stops 23 in a manner which will be described in more detail below.

The frame 11 can be constructed of any rigid material and at all times remains stationary relative to the printing press. The pallet end wall 14 has a facially open upper portion so as to allow the false pallet top 24 to pass therethrough. The press end wall 15 likewise has a facially open upper portion to allow printed works from the printing press to pass therethrough. The base 12, walls 14 and 15, and top 13 define a printed work receiving chamber 25.

Figure 2:
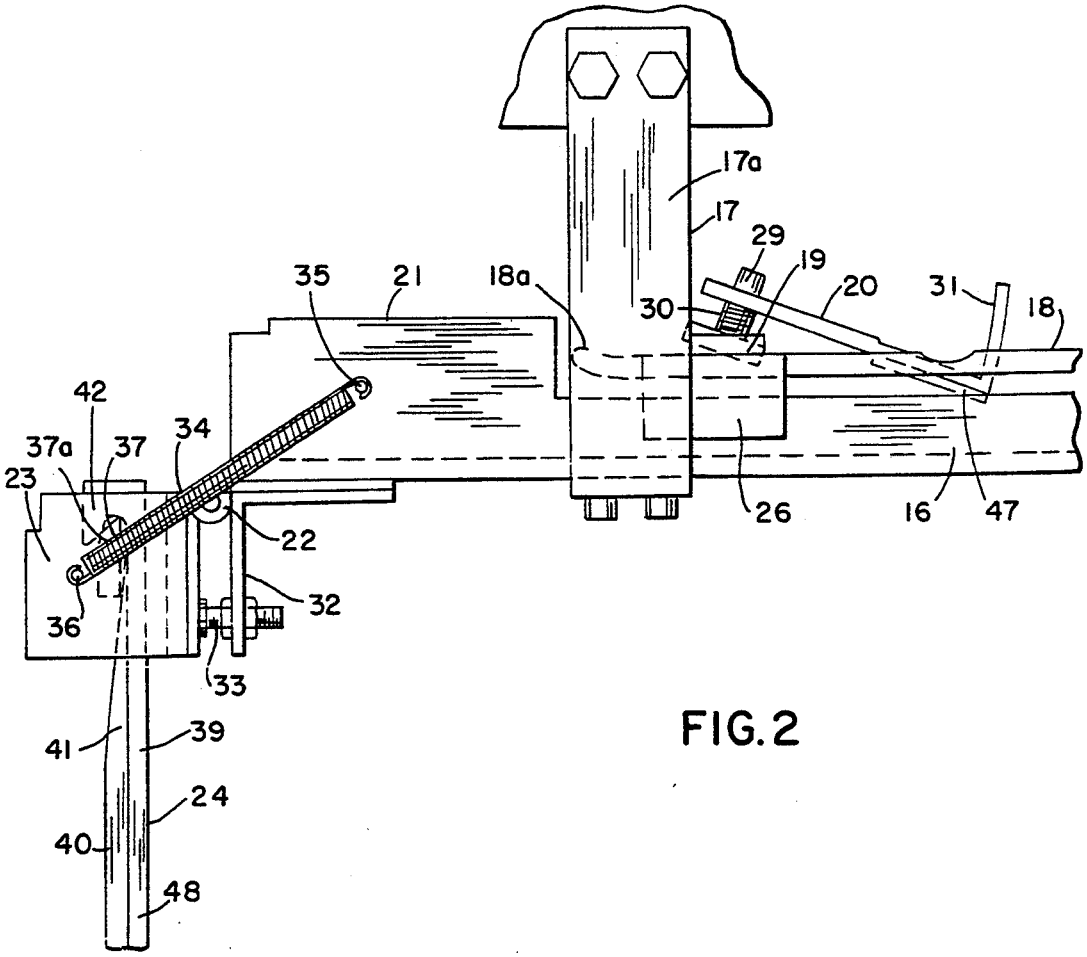
FIG. 2 is an enlarged partial view of the printed work-receiving station of FIG. 1.

As best seen in FIG. 2 in the preferred embodiment, the upper extension 17*a* of each elbow bracket 17 is securely fastened to the frame top 13 inside and adjacent the pallet end wall 14 at least two spots each to eliminate bracket rotation. Each track 16 is securely mounted to the lower extension 17*b* of one bracket 17 and extends parallel to the frame top 13 through the press end wall 15 to a point just short of the press outlet as seen in FIG. 1.

Figure 3:
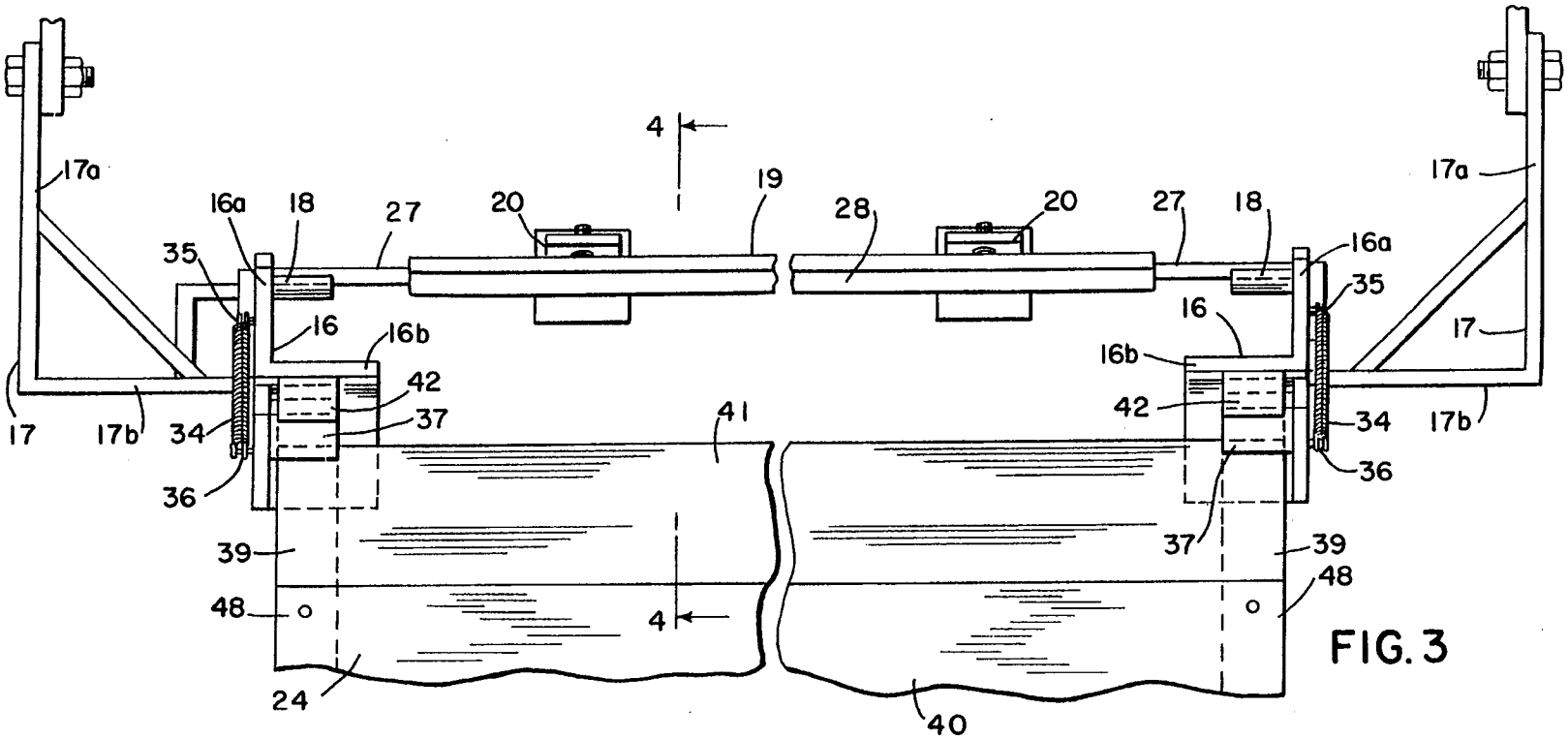
FIG. 3 is an enlarged partial end view of the printed work-receiving station of FIG. 1.

As seen in FIG. 3, the tracks 16 are positioned so as to define a plane within which the false pallet top 24 fits. Each track 16 has a vertical member 16*a* that functions to align the false pallet top 24 laterally with the press outlet, and a horizontal shelf member 16*b* which both provides support for the false pallet top 24 when the top 24 is in the receiving position as in FIG. 6 and also aligns the pallet top 24 longitudinally under the press outlet. The tracks 16 are constructed of a strong, rigid material to provide ample support for both the false pallet top 24 and the printed work that accumulates during use of the false pallet top 24. It should be understood that extra elbow brackets can be provided near the press end wall 15 to provide more support to the tracks 16 if desired.

Figure 4:
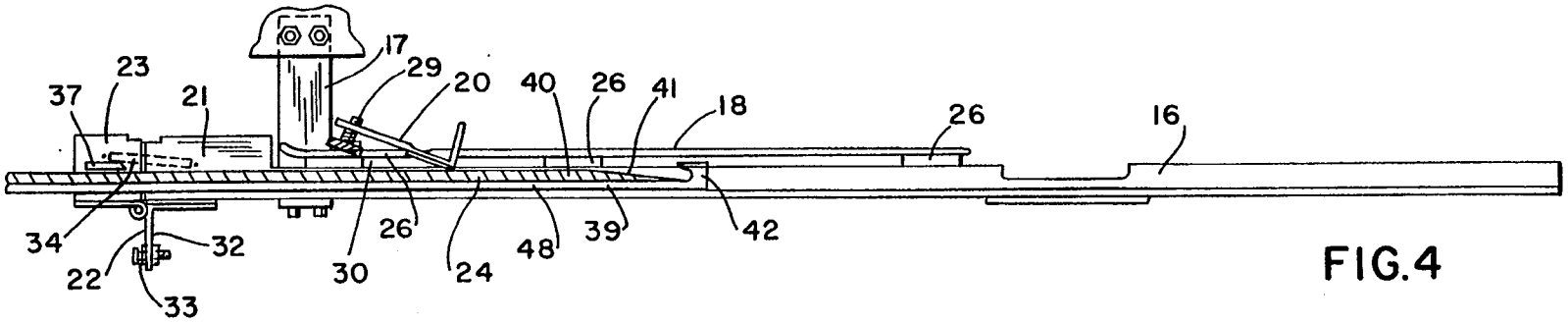
FIG. 4 is an enlarged partial side view of the top portion of the printed work receiving station of FIG. 1 taken along lines 4—4 in FIG. 3.

Turning to FIG. 4, track extension 21 is provided at one end of each track 16 extending through the facially open upper portion of the pallet end wall 14. Each extension 21 provides a mounting surface for the hinges 22 which connect the extensions 21 to two pivot stops 23. When the false pallet top 24 is pivoted into the intermediate horizontal position, the pivot stops 23 abut, and are restrained from further upward pivotal movement by, the vertical edges of the extensions 21. When in this up position, the false pallet top 24 is in optimal alignment with the support tracks 16 and can easily be inserted into its receiving position (see FIG. 6).

In the preferred embodiment, a cover strip 18 is fastened directly above each track 16 by three fastening members 26 (seen best in FIGS. 1 and 4). Each strip 18 begins adjacent the track bracket 17 connection and extends horizontally along half the length of each track 16 toward the press outlet. Each strip 18 has a flange 18*a* at one end that guides the false pallet top 24 onto the tracks 16.

Turning again to FIG. 3, the cross bar 19 is a rigid elongated metal fitting having two co-planar flat rectangular ends 27 that function as mounting surfaces for the bar 19. Each end 27 is horizontally and securely fastened to one of the strips 18 adjacent each elbow bracket 17. As seen in FIG. 3, in the preferred embodiment the midsection 28 of the bar 19 is also rectangular and flat, but it is constructed in a plane rotated twenty degrees from that of the bar ends 27. A screw 29 holds each retaining member 20 against a compression spring 30 and is threadably received in the midsection of the bar 19. Each screw 29 is tightened so as to allow the spring 30 to remain flexible yet partially compressed. Each spring 30 acts to bias the upper section of its retaining member 20 against the head of the screw 30 with the lower end of each retaining member 20 extending partially into the plane defined by the tracks 16. Each retaining member 20 has a distal foot 31 that communicates with printed works on the false pallet top 24. As best seen in FIG. 2, each foot 31 leans a few degrees away from vertical toward the press to keep the printed works from following the false pallet top 24 upon removal from the receiving position.

As noted above, in keeping with one of the principal objects of the invention, two pivot stops 23 are connected to the track extensions 21 by two hinges 22. The hinges 22 allow the pivot stops 23 and false pallet top 24 to pivot from the stored vertical position (see FIG. 1) to an intermediate horizontal position (see FIG. 5). As seen in FIG. 2, in the preferred embodiment there is a stop bracket 32 complete with a stopping post 33 fastened under each hinge 22. When the false pallet top 24 is stored, the hinges 22 abut the posts 33 and pivotal downward movement of the top 24 is restrained. The pivot stops 23 are shaped and positioned so that when the top 24 is in a horizontal position the pivot stops 23 effectively operate as extra track extensions.

A looped end helical spring 34 is provided between each track extension 21 and its adjacent pivot stop 23 that helps to maintain the pivot stops 23 in communicating position with the extensions 21 when the false pallet top 24 is in a horizontal position. Each extension 21 has an outwardly extending post 35 that securely receives one looped end of the spring 34. A similar post 36 is provided on the outside of each pivot stop 23 to securely receive the other looped end of the spring 34. The spring 34 is sized so that it has sufficient strength to overcome the weight of the pivot stop 23 alone (e.g. maintaining the pivot stop 23 in communication with the support track 16 when the pallet top 24 is in the receiving position), but has insufficient strength to overcome the weight of the pivot stop 23 and top 24 together (e.g. unable to maintain the pivot stops 23 and top 24 horizontal when the top 24 is not in the receiving position).

As best seen in FIGS. 2 and 3, there is a catch member 37 that protrudes out from the interior vertical wall of each pivot stop 23. Each catch member 37 has a tapered upper end 37*a* that facilitates easy reception in the false pallet top hanger 39 as described below. Each catch member 37 is sized so that when the false pallet top 24 is in the stored vertical position, the tapered upper end 37*a* contacts the entire width of the pallet hanger 39 to provide ample support for the vertically stored top 24. Both the hanger members 39 and the catch members 37 are constructed of a strong rigid material that will not deform under the weight of the false pallet top 24.

The false pallet top 24 consists of two hanger members 39, two nylon runners 48 of substantially the same cross section as the hanger members 39 and a plate 40 that has a tapered end 41. Each hanger member 39 is an elongated strip of rigid, lightweight material that runs a sufficient distance along length of the plate 40 to allow secure attachment thereto and has a bend 42 extending off the tapered end 41 of the plate 40. The nylon runners 48 abut the ends of the hanger members 39 opposite the bends 42 and extend along the remaining length of the plate 40 to facilitate easy insertion and removal of the plate 40. In the preferred embodiment both the hanger members 39 and the nylon runners 48 are secured to the plate 40 by flat socket cap screws (not shown).

As seen in FIG. 1, in the stored position, the plate 40 connected to the hanger members 39, hangs vertically downward alongside and parallel to the pallet end wall 14. In the preferred embodiment, the plate 40 is a flat aluminum plate which can easily be lifted and moved manually. In order to reduce friction between printed works that accumulate on the plate 40 and the plate 40 itself, and to facilitate inserting the plate 40 between adjacent pieces of printed work, in the preferred embodiment, the plate 40 is covered with a lubricating plastic such as PTFE, sold under the trademark name TEFLON (a low friction material produced by E.I. Dupont Nemours Co.). As noted above, one end of the plate 40 has a tapered edge 41 which further facilitates inserting the plate 40 between adjacent pieces of printed work. The opposite end of the plate 40 has a handle hole which allows gripping of the plate 40 for pivoting, inserting and retracting movement.

As seen in FIGS. 5 through 8 a real pallet 43, is positioned on a pallet floor 44 inside the printed work receiving chamber 25. The preferred embodiment of the present invention uses several chains 45 extended from synchronized electric winding motors (not shown) located above the frame top 13 to raise and lower the pallet floor 44 which in turn supports the real pallet 43 in its press output receiving position. As work accumulates on the pallet 43, the chains 45 are lengthened so as to keep the top of the accumulated printed work Just under the press output. It should be understood that the real pallet positioning mechanism could take many other forms.

In operation, as seen in FIG. 1, when the false pallet top 24 is in the stored position the pivot stops 23 and their respective hinge members 22 abut the stopping posts 33 and hold the false pallet top 24 in a vertical position parallel to the pallet end wall 14. As best seen in FIG. 2, when the false pallet top 24 is stored, the hanger members 39 are hooked on the upper ends 37*a* of the catch members 37.

When the real pallet 43 is nearing its fully loaded capacity as in FIG. 5, without turning off the printing press, an operator can swing the false pallet assembly 24 vertically upward until the pivot stops 23 abut their respective track extensions 21 at which point the intermediate horizontal position is achieved, the helical springs 34 (not seen in FIGS. 5–8) contract and further vertical lifting is restrained. In this position, the false pallet assembly 24 is aligned with the track extensions 21 and can easily be inserted therebetween.

As seen in FIG. 6, the false pallet assembly 24 is pushed toward the press and onto the track extensions 21 which unhooks the hangers 39 from the catch members 37 and places the hangers 39 in contact with the cover flanges 18*a* (see FIG. 2). The flanges 18*a* guide the hangers 39 into sliding communication with the tracks 16. When the false pallet assembly 24 is pushed further, the plate 40 makes contact with the lower end of each retaining member 20 and forces each member 20 up out of the plane defined by the tracks 16. The compression springs 30 continue to bias the retaining members 20 against the plate 40 and toward their steady state position within the plane defined by the tracks 16. Upon full insertion the false pallet assembly 24 is in the receiving position and begins to receive printed works which are restrained in their lateral movement by the two retaining members 20. At this point, the helical springs 34 are contracted and effectively act to bias each pivot stop 23 against its connected track extension 21.

The chains 45 holding up the fully loaded real pallet 43 are then simultaneously lengthened to lower the pallet 43 into a position where it is removed and replaced by an empty pallet 46. The chains 45 are then shortened again as in FIG. 7 to move the empty pallet 46 directly under the false pallet assembly 24.

To remove the false pallet top 24 the operator again grips the plate 40 and pulls it away from the printing output. During removal, each distal foot 31 on the retaining members 20, being biased against the plate 40 toward the plane defined by the tracks 16, stops the printed work from following the false pallet assembly 24 out of the open portion of the pallet end wall 14. As the false pallet assembly 24 is removed, the accumulated printed work falls directly below onto the empty pallet 46.

Continued removal of the false pallet assembly 24 causes the hanger members 39 to rehook the catch members 37. Once rehooked, the false pallet top 24 can be swung down into its vertical storage position as in FIG. 8 where it remains until the empty pallet 46 nears a fully loaded state at which point the above operation is repeated.

It should be understood that many variations on the preferred embodiment disclosed above are possible. For instance, in one embodiment, the hanger members 39 may extend the entire length along the plate 40 to securely fasten the plate 40 to the hangers 39. In another embodiment, as can be seen in FIG. 2, a small wear strip 47 is provided on the corner of the retaining member distal foot 31. This strip 47 is positioned at the retaining member's 20 lowest point in the plane defined by the tracks 16 and makes frictional contact with the plate 40 when the plate 40 is being moved into or out of the receiving position (see FIG. 4). This strip 47 is constructed of a less resilient plastic than that covering the plate 40 in order to absorb most of the wear from the friction between the plate 40 and the retaining members 20 which in turn limits damage to the plate 40. This strip 47 can be easily replaced when sufficiently worn down. Because many variations are possible from the preferred embodiment described herein without departing from the spirit of the invention, the invention is not to be limited by the specific description above, but should be defined by the claims.

We claim:

1. A printed work receiving station for a printing press having an outlet from which printed work exits, said station including means for both raising an empty pallet to receive printed work exiting from the outlet and for subsequently lowering the pallet as it becomes loaded with printed work, a single substantially rectangular false pallet top comprising a single substantially rectangular sheet of rigid material coated with a low friction material, the false pallet top hingedly connected to the station for movement between a stored vertical position along a side of the station and an intermediate horizontal position outside the station opposite the outlet, said false pallet top being slidable from the intermediate horizontal position into a horizontal receiving position within the station wherein the false pallet top is completely covering the top of a loaded pallet, and means for supporting the false pallet top in the horizontal receiving position above and over the top of the loaded pallet so that printed work exiting the press collects on the false pallet top and the loaded pallet can be removed and replaced with an empty pallet without stopping the printing press, said false pallet top being subsequently slidable from the horizontal receiving position under the printed work to the intermediate horizontal position outside the station so that the printed work is deposited on the empty pallet.

2. A printed work receiving station of claim 1 in which the false pallet top is imperforate.

3. A printed work receiving station of claim 1 in which the means for supporting the false pallet top in a stable horizontal position adjacent the outlet of the printing press is a pair of horizontal tracks.

4. A printed work receiving station of claim 1 which includes retaining means for holding the printing work in place so that the false pallet top can be withdrawn from the horizontal position without the printed work collected thereon following the false pallet top.

5. A printed work receiving station of claim 1 which includes means which permit the false pallet top to be stored in a vertical position when not in use.

6. A printed work receiving station of claim 1 wherein the low refriction material is polytetrafluroethelyne.

7. A printed work receiving station for a printing press having an outlet from which printed work exits, said station including means for both raising an empty pallet to receive printed work exiting from the outlet and for subsequently lowering the pallet as it becomes loaded with printed work, a false pallet top connected to the station for movement between a stored vertical position along a side of the station and a horizontal receiving position within the station, and means for supporting the false pallet top in the horizontal receiving position above and over the top of a loaded pallet so that printed work exiting the press collects on the false pallet top and the loaded pallet can be removed and replaced with an empty pallet without stopping the printing press, said false pallet top being subsequently slidable from the horizontal receiving position under the printed work to the stored vertical position along a side of the station so that printed work is deposited on the empty pallet, wherein the improvement is that the false pallet top comprises:

a single substantially rectangular sheet of rigid material coated with a low friction material, the false pallet top completely covering the loaded pallet when in the horizontal receiving position.

* * * * *